United States Patent [19]

Ciumaga

[11] Patent Number: 4,873,900

[45] Date of Patent: Oct. 17, 1989

[54] SCREW DRIVING DEVICE

[76] Inventor: Massimo Ciumaga, 1639 Bissonnett, Houston, Tex. 77005

[21] Appl. No.: 944,470

[22] Filed: Dec. 8, 1986

[51] Int. Cl.[4] ..... B25B 15/02

[52] U.S. Cl. ..... 81/436

[58] Field of Search ..... 81/436; D8/82, 86

[56] References Cited

U.S. PATENT DOCUMENTS

| | | | |
|---|---|---|---|
| D. 112,592 | 12/1938 | Velepec . | |
| D. 229,475 | 12/1973 | Uboldi . | |
| 1,479,506 | 1/1924 | Kellemen . | |
| 1,787,087 | 12/1930 | Robertson | 81/436 |
| 3,405,748 | 10/1968 | Sorteberg . | |
| 3,897,812 | 8/1975 | Arnn . | |
| 3,923,088 | 12/1975 | Arnn | 81/436 |
| 4,105,056 | 8/1978 | Arnn . | |
| 4,311,071 | 1/1982 | Bassell . | |
| 4,339,971 | 7/1982 | Zatorre . | |

FOREIGN PATENT DOCUMENTS 2131114A 6/1984 United Kingdom .

OTHER PUBLICATIONS

American Machinist, 8/29/1946, p. 126.

*Primary Examiner*—Debra Meislin

*Attorney, Agent, or Firm*—Pravel, Gambrell, Hewitt, Kimball & Krieger

[57] ABSTRACT

An improved device is disclosed for driving slotted head fasteners. The invention involves the use of a straight bit with parallel opposing surfaces to apply torque to the fastener slot over an increased area and reduce the tendency of the bit to slip out of the slot.

2 Claims, 1 Drawing Sheet

SCREW DRIVING DEVICE

TECHNICAL FIELD OF THE INVENTION

The invention is a type of tool for use in turning fastening devices. The fastening devices relevant could be screws, whether machine, wood, or sheet metal type, bolts, cam-lock fasteners, or any other device which is operated by introducing torque at one end. The tool can be directly hand driven, turned by a hand wrench, or turned by an impact wrench.

DESCRIPTION OF THE BACKGROUND AND PRIOR ART

The typical screw type slotted head fastener in use is driven by introducing a torque to a slot in the head of the screw by use of a screw driver. The same method is used whether the screw is driven clockwise or counterclockwise, whether tightening or loosening. The most troublesome faults with this method of driving screws are that the screw driver tends to come out of the slot under high torque and that the outer edges of the slot tend to chip or deform when slippage occurs or when repetitive installation and removal are necessary.

The typical screw driver has a tapered blade which fits into the screw slot, which, conversely, has parallel faces. The result of this combination is that the end of the blade is narrow by comparison with the width of the slot, allowing the screw driver axis to be at an angle with the axis of the screw. In addition, the contact between the screw driver and the screw is made at the top edge of the slot, where the screw contacts the tapered edge of the screw driver blade at two points. When torque is applied to the screw driver, this axial misalignment and point contact cause one component of the force applied to push the screw driver out of the slot. This is the first fault alluded to above. The second fault is related. When the screw driver slips out of the slot because of this mismatch of tapered and parallel surfaces, the top edge of the slot frequently chips or burrs because the point loading exceeds the material strength just prior to the blade clearing the slot. Further, even if wholesale failure of the material at the top edge of the slot does not occur, repeated application of point loading at the top of the slot frequently causes abrasion or creep of the material, resulting in a slot with rounded edges which is no longer capable of transmitting torque to the screw.

The prior art exhibits several attempts to alleviate these problems. The most relevant of these attempts are described below, but none are as effective at solving the problems as the present invention.

U.S. Pat. No. 3,923,088 exhibits a blade 20 with opposing concave surfaces 22 the purpose of which is to allow the lower edge 30 of the blade to bite into the screw slot faces to resist the tendency of the blade to leave the slot. This configuration removes material from the blade, causing it to be weaker than the present invention. Because of the complicated shape, manufacture of the screw driver would also be much more difficult. If failure of the blade occurs, the average user would not be able to restore it to its original shape.

U.S. Pat. No. 3,897,812 exhibits a similar configuration with complicated contours which suffers from the same drawbacks.

U.S. Pat. No. 3,405,748 shows a straight bit 5 with parallel surfaces. Its torsion tube construction requires that for a given bit width, the shank must be considerably smaller and weaker than that of the present invention, given the same material of manufacture. It also will require a greater number of more difficult manufacturing operations, and the tube would be far more difficult to clean, a feature which is anathema to the precision work in which such tools are frequently used.

U.S. Pat. No. 1,479,506 shows a blade with concave surfaces like those previously discussed, with the same drawbacks. U.S. Pat. Nos. 4,105,056 and 4,311,071 exhibit blades with thin sections in the center which will suffer from weakness compared to the present invention and which will be more difficult to manufacture and impossible to repair.

U.S. Design Pat. Nos. 112,592 and 229,475 show apparently flat bits which are also difficult to manufacture and impossible to repair.

SUMMARY OF THE INVENTION

The object of the present invention is to produce a screw driver which will not easily twist out of a standard straight screw slot. This is accomplished by constructing a blade on the end of a shank with a bit which has parallel opposing surfaces. This ensures that the contact between the screw driver and the screw slot occurs along two parallel or very nearly parallel lines rather than at two points located on sharply diverging lines as found in the most common screw driver. The advantages it exhibits over the prior art are that it is easily manufactured, it is easily repaired, it fits a standard screw slot, and it does not involve the removal of any material, which would reduce strength. It can feature a shank of any known configuration, including round and multifaceted. It can feature a single taper along the edges of the bit while the two other opposing surfaces are parallel, or it can feature a bit with two sets of opposing parallel sides. The former type of bit is discussed in the alternate embodiments exhibited in the drawings, but it is understood that the latter type is also disclosed.

BRIEF DESCRIPTION OF THE DRAWINGS

A detailed description of the features of the invention will follow. To aid in the detailed description reference will be made to the following drawings.

DETAILED DESCRIPTION OF THE INVENTION

The invention involves a screw driving device having a special construction at one end for engaging a screw.

Figure 2:
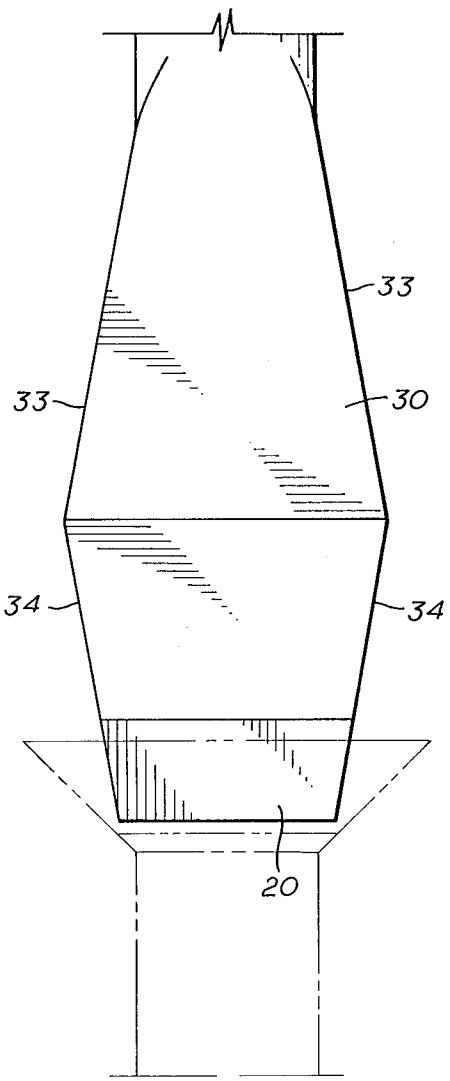
FIG. 2 is an elevation of the invention rotated 90° from the view of FIG. 1.
Figure 1:
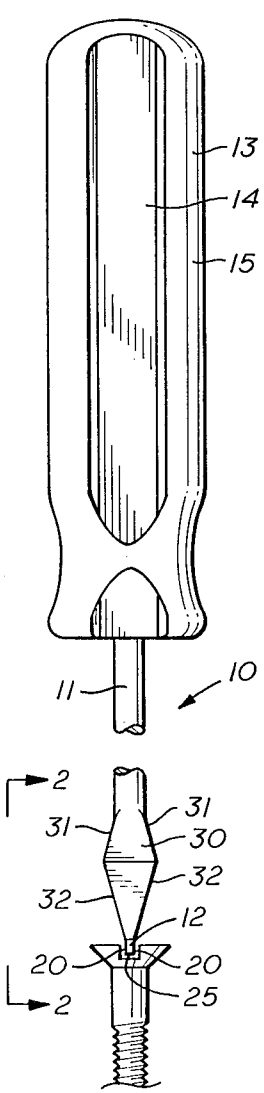
FIG. 1 is an elevation of the screw driving device showing an end view of the slot in a typical screw head and an edge bit of the screw driving device as it fits into a slot.

As shown in FIGS. 1 and 2, the preferred embodiment of the screw driving device 10 comprises a shank 11 with a bit 12 on one end and a handle 13 on the other end. In the preferred embodiment, the handle 13 features multiple longitudinal ribs 14 around its perimeter with grooves 15 in between to facilitate gripping by hand. Alternatively, other driving means can be used in place of the handle shown, such as a square socket to engage a ratchet driver.

The shank 11 extends from the handle 13 to the end surface 25 in one piece. Near the bit 12, the shank 11 is formed into a blade 30 which varies in cross-sectional area, first increasing by virtue of outward tapering surfaces 31,33 then decreasing by virtue of inward tapering surfaces 32,34. From the end of surface 32 to the end surface 25, the bit 12 has parallel surfaces 20 on two opposite sides while tapering surfaces 34 continue to surface 25, which is flat, rectangular, and perpendicular to the longitudinal axis of the shank. Surfaces 20, as can be seen in FIGS. 1 and 2, are parallel to the longitudinal axis of the shank and parallel to the longitudinal axis of the screw lot. Other than the cross-sectional variations described, the shank 11 can be round or multifaceted in cross-section as desired, such options being well known to those skilled in the art. As can be seen in FIGS. 1 and 2, the cross-sectional area of bit 20 is not greater than the cross-sectional area of the blade at the point at which the blade meets the bit.

Figure 4:
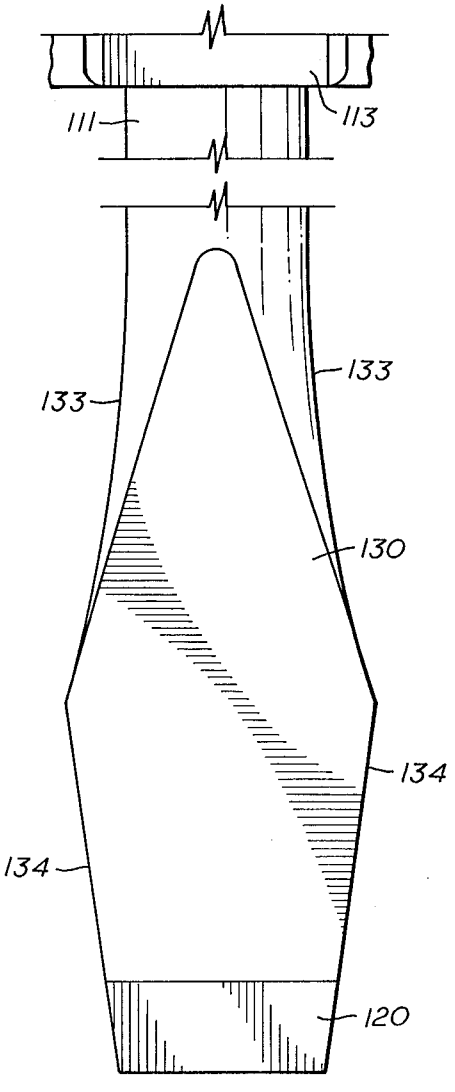
FIG. 4 is an elevation of the same alternative embodiment of the invention rotated 90° from the view of FIG. 3.
Figure 3:
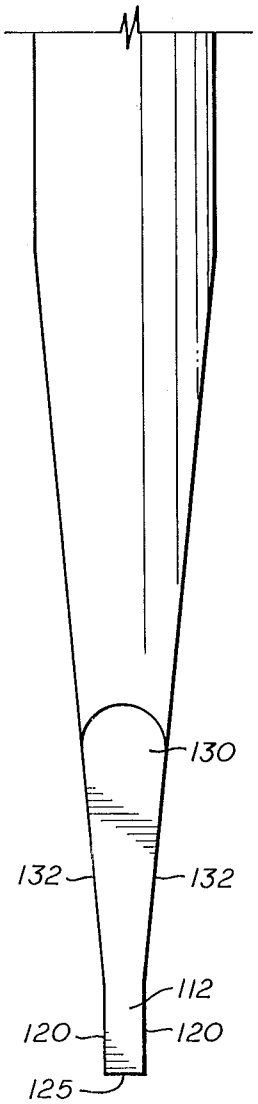
FIG. 3 is an elevation of an alternative embodiment of the invention showing an edge view of the bit.

An alternative embodiment of the invention is shown in FIGS. 3 and 4 wherein the shank 111 extends from the handle 113 to the blade 130 where outwardly tapering surfaces 133 increase the transverse dimension of the shank beginning at the approximate longitudinal location where inwardly tapering surfaces 132 begin. Surfaces 133 can have a flat or a contoured configuration. At the second edge of surfaces 133, inwardly tapering surfaces 134 begin reducing said transverse dimension to its termination at surface 125. Inwardly tapering surfaces 132 terminate at parallel surfaces 120 which also terminate at surface 125, which is flat, rectangular, and perpendicular to the longitudinal axis of the shank.

I claim:

1. A screw driving device comprising:

a shank;

a bit of rectangular cross-section formed at an end of the shank, two opposing surfaces of said bit being parallel to one another, parallel to the longitudinal axis of the shank and, when inserted into a screw slot, parallel to the longitudinal axis of the screw slot;

a flat surface on an end of said bit, wherein said flat surface is perpendicular to the longitudinal axis of said shank;

a means for applying torque to said shank; and a blade of rectangular cross-section formed onto the end of said shank, upon which said bit is formed, wherein said blade tapers outwardly on all sides from said shank to a dimention greater than the diameter of said shank and wherein said blade thence tapers inwardly on all sides to the point where said bit is formed, the bit having a cross-sectional area not greater than the cross-sectional area of the blade at the point at which the blade meets the bit.

2. The screw driving device of claim 1 wherein said means of applying torque is longitudinal handle with alternating longitudinal ribs and grooves.

* * * * *